United States Patent [19]

Inui et al.

[11] 4,407,002

[45] Sep. 27, 1983

[54] HEAT TRANSFER TYPE THERMAL RECORDING APPARATUS

[75] Inventors: Toshiharu Inui; Yoshiki Kikuchi; Takashi Ohmori, all of Ebina, Japan

[73] Assignee: Fuji Xerox Co., Ltd., Tokyo, Japan

[21] Appl. No.: 320,151

[22] Filed: Nov. 10, 1981

[30] Foreign Application Priority Data

Nov. 17, 1980 [JP] Japan ..... 55-163489

[51] Int. Cl.[3] ..... B41J 3/10; B41J 3/20

[52] U.S. Cl. ..... 346/76 PH; 400/120

[58] Field of Search ..... 346/76 R, 76 PH, 140 R, 346/135.1, 1.1; 355/16

[56] References Cited

U.S. PATENT DOCUMENTS

| | | | |
|---|---|---|---|
| 2,953,470 | 9/1960 | Green et al. | 346/1.1 |
| 3,155,451 | 11/1964 | Dunster et al. | 346/1.1 |
| 3,475,760 | 10/1969 | Carlson | 346/1.1 |
| 3,483,531 | 12/1969 | du Rudnay | 346/76 X |
| 4,108,550 | 8/1978 | Moraw | 355/16 X |
| 4,136,943 | 1/1979 | Koizumi | 355/16 X |
| 4,195,937 | 4/1980 | Baran | 346/76 PH X |

OTHER PUBLICATIONS

I.B.M. Technical Disclosure Bulletin, vol. 11, No. 4, Sep. 1968, pp. 401–402.

I.B.M. Technical Disclosure Bulletin, vol. 18, No. 8, Jan. 1976.

*Primary Examiner*—Donald A. Griffin

*Attorney, Agent, or Firm*—Sughrue, Mion, Zinn, Macpeak and Seas

[57] ABSTRACT

The negative image left on an ink donor sheet after thermal recording is erased by heating the remaining ink at a point downstream of the recording station and either removing the remaining ink or spreading the ink to obliterate the negative image.

7 Claims, 6 Drawing Figures

HEAT TRANSFER TYPE THERMAL RECORDING APPARATUS

BACKGROUND OF THE INVENTION

This invention relates to a heat transfer type thermal recording apparatus which permits erasure of information remaining on an ink donor sheet after heat transfer recording.

There are known heat transfer type thermal recording apparatus having a thermal head which supplies heat selectively to an ink donor sheet coated with a hot-melt solid ink in accordance with pictorial information. The ink is melted by heat, and is transferred onto a sheet of paper superposed on the ink donor sheet to thereby record information. According to such apparatus, however, a negative image of the pictorial information transferred onto the paper is left on the ink donor sheet. Therefore, if this apparatus is used for recording highly confidential information, there is a substantial possibility that the information could be discovered through the ink donor sheet.

SUMMARY OF THE INVENTION

In view of these circumstances, it is an object of this invention to provide a heat transfer type thermal recording apparatus which permits erasure of information remaining on an ink donor sheet which has been used for recording purposes.

Briefly, according to this invention, this object may be attained by the thermal processing of the ink donor sheet. More particularly, the remaining ink can be subjected to heating at a point downstream of the recording station and the ink spread around on the donor sheet to obliterate the image. Alternatively, the ink can be entirely removed from the donor sheet at the downstream heating station either by scraping away the ink and collecting it for reuse or by transferring the ink onto a second recording sheet to form a negative image recording.

BRIEF DESCRIPTION OF THE DRAWINGS

This invention will now be described in further detail with reference to the accompanying drawings, in which.

DETAILED DESCRIPTION OF THE INVENTION

Figure 1:
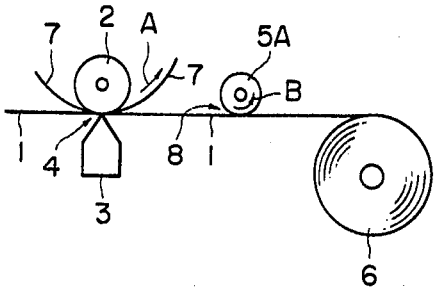
FIG. 1 is a schematic view showing the essential arrangement of the heat transfer type thermal recording apparatus according to a first embodiment of this invention.

FIG. 1 shows a thermal recording apparatus according to a first embodiment of this invention. In this apparatus, an ink donor sheet 1 delivered from a supply roll (not shown) passes through a recording station 4 defined between a back roll 2 and a thermal head 3, moves past a heating bar 5, and is wound on a take-up roll 6. A sheet of recording paper 7 is superposed on the ink donor sheet 1 in front of the recording station 4. Ink on the donor sheet is selectively melted at the recording station 4 and transferred onto the paper 7. Then, the paper 7 is separated from the ink donor sheet 1, and moved forward in the direction of an arrow A in FIG. 1 for delivery into a paper tray (not shown).

The ink layer on the ink donor sheet 1 which has passed through the recording station 4 no longer carries an ink in an area corresponding to black pictorial information, but the ink still remains in an area corresponding to white pictorial information. The heating bar 5A, which comprises a heated roll, is in contact with the ink layer on the ink donor sheet 1, and rotates in the direction of an arrow B. A part of the ink melted by contacting the heating bar 5A is transferred onto the heating bar 5A, and as the heating bar 5A rotates, the ink moves around the heating bar 5A, and collects in a region 8 between the ink donor sheet 1 and the heating bar 5A in front of the heating bar 5A. When that area of the ink layer on the ink donor sheet 1 which does not carry any ink has reached the region 8, it is coated with the ink therein, whereby the information remaining on the ink donor sheet is erased. An increase in the amount of the ink collected in the region 8 in front of the heating bar 5A brings about an increase in the amount of the ink remaining on the ink donor sheet 1 after it passes the bar 5, so that the amount of the ink staying in the region 8 reaches an equilibrium. Thus, the apparatus of this invention does not require any positive removal of ink from the region 8.

Figure 2:
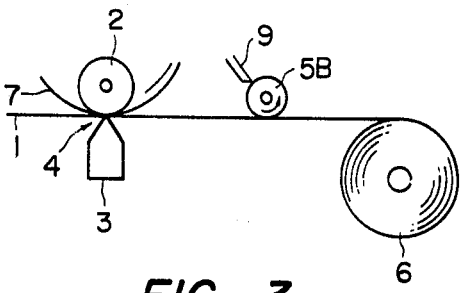
FIG. 2 is a schematic view showing the essential arrangement of the heat transfer type thermal recording apparatus according to a second embodiment of this invention.

FIG. 2 shows a thermal recording apparatus according to a second embodiment of this invention. Like numerals are used to designate like parts in both FIGS. 1 and 2. The apparatus of FIG. 2 includes a heating bar 5B to which all of the ink remaining on the ink donor sheet 1 is transferred. The ink transferred to the heating bar 5B is recovered therefrom in a molten state by a blade 9 contacting the heating bar 5B with the rotation of the heating bar 5B. Thus, this apparatus permits reuse of the recovered ink.

It is also sometimes desirable to obtain a negative image of the recording, but in a conventional apparatus it has always been necessary to feed an inverted image signal to a thermal head contacting the ink donor sheet, and it is impossible to obtain positive and negative images simultaneously. Accordingly, if it is desired to obtain a positive copy and also reproduce a negative image, it is necessary to transmit the same pictorial information twice and reproduce positive and negative images separately.

According to this invention, the ink can be removed from the donor sheet and advantageously used for production of a negative image, if desired. This will be described with reference to FIGS. 3–6.

Figure 3:
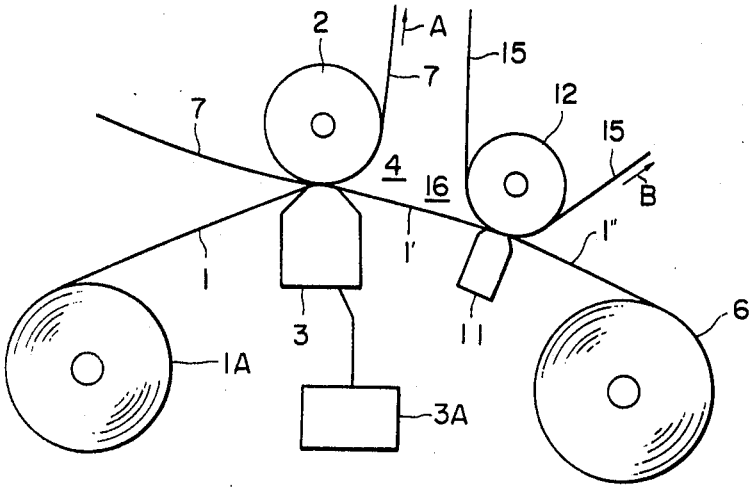
FIG. 3 is a view showing the essential arrangement of the simultaneous positive and negative image recording apparatus according to this invention.

Referring first to FIG. 3, there is shown the essential arrangement of an embodiment of this invention which performs simultaneous positive and negative image recording. This apparatus comprises two recording stations 4 and 16. In the first recording station 4, an ink donor sheet 1 delivered from a supply roll 1A produces a positive image on first recording paper 7, while in the second recording station 16, the ink donor sheet 1' arriving from the first recording station 4 after transfer of the positive image therein produces a negative image on second recording paper 15.

Figure 4:
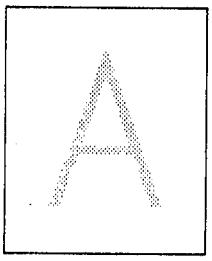
FIG. 4 is a top plan view showing an example of an original copy.

The first recording station 4 comprises a thermal head 3 having a heating resistor which is selectively activated for heating the ink donor sheet 1 in accordance with information transmitted thereto from an image signal source 3A, as is well known, and also includes a first back roll 2 by which the ink donor sheet 1 and the first recording paper 7 superposed thereon are pressed against the thermal head 3. If the signal source 3A transmits an image signal indicating an original copy showing the letter 'A' as illustrated in FIG. 4, the heating resistor is activated in the regions corresponding to the black picture elements, whereby a positive image duplicating the original copy is reproduced on the first recording paper 7. The first recording paper 7 is separated from the ink donor sheet 1' from which the positive image has been reproduced, and travels in the direction of an arrow A for delivery into a positive image recorded paper tray (not shown).

Figure 5:
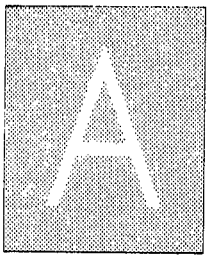
FIG. 5 illustrates an ink pattern of an inverted image of the original copy shown in FIG. 2.

The second recording station 16 comprises a heater 11 which heats the base or back surface of the ink donor sheet 1' across its entire width, and a second back roll 12 by which the ink donor sheet 1' and the second recording paper 15 superposed thereon are pressed against the heater 11. If the image shown in FIG. 4 is transferred onto the first recording paper 7 in the first recording station 4, the ink donor sheet 1' then is left with an ink pattern showing the letter 'A' in dark background as illustrated in FIG. 5. This ink pattern is melted or sublimed by the heater 11, and transferred onto the second recording paper 15 in the second recording station 16, whereby a negative image of the original copy is reproduced on the second recording paper 15. The paper 15 is then separated from the ink donor sheet 1'', and travels in the direction of an arrow B for delivery into a negative image recorded paper tray (not shown). The ink donor sheet 1'', from which all ink has now been transferred, is wound on a take-up roll 6.

Figure 6:
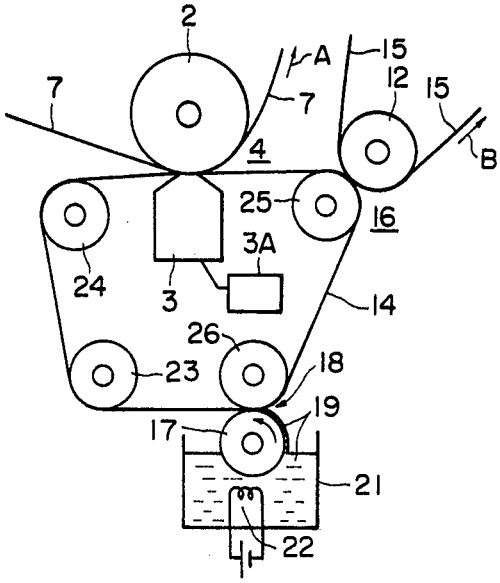
FIG. 6 is a view showing the essential arrangement of a variation of the simultaneous positive and negative image recording apparatus according to this invention.

Referring now to FIG. 6, there is schematically shown a second arrangement according to this invention which achieves simultaneous positive and negative image recording. Like numerals are used to designate like parts in both FIGS. 3 and 6. This apparatus employs an endless ink donor belt 14 adapted for repeated use, instead of a throwaway ink donor sheet. Accordingly, there is no significant security problem, but the apparatus is still useful in simultaneously obtaining positive and negative images if desired. In an ink supply station 18 defined between a pair of ink supply rolls 26 and 17, the ink donor belt 14 has its outer surface coated uniformly with an ink 19 supplied in a fluid state by the supply roll 17. Since the ink 19 solidifies at room temperature, the supply roll 17 and the interior of an ink tank 21 supplying the ink 19 to the supply roll 17 in fluid state are heated by a heater 22.

The ink-coated portion of the ink donor belt 14 is fed past first and second guide rolls 23 and 24 into the first recording station 4 to perform recording on the first recording paper 7 by heat transfer. That portion of the ink donor belt 14 is then fed into the second recording portion 16 defined by a heating roll 25 and a second back roll 12, and ink is melted by the heating roll 25 for transfer onto the second recording paper 15. Thus, a positive image duplicating the original copy is reproduced on the recording paper in the first recording station, while a negative image having the inverted brightness of the original copy is reproduced in the second recording station 16.

According to this invention, therefore, the solid ink either covers the whole surface of the ink donor sheet which has been used for recording purposes, or is completely removed therefrom. Thus, there is no divulgence of information through the ink donor sheet.

Further according to this invention, it is economically possible to obtain positive and negative images simultaneously by employing a single ink donor sheet or belt. Since the ink donor sheet leaving the second recording station no longer carries pictorial information, there is no fear of confidential information being divulged through the ink donor sheet collected on the take-up roll.

In the embodiment of FIGS. 1 and 2, a roll has been used as a heating bar. It is possible to selectively use various types of rolls, such as a gravure roll, a silicon roll or a metal roll, depending on the relationship between the roll and the ink donor sheet, the presence of the blade, or other factors. There is no definite relation between the peripheral velocity of the roll and the traveling speed of the ink donor sheet. In some cases, it is, of course, possible to cause the roll to rotate in the direction opposite to that in which the ink donor sheet travels. Moreover, the heating bar does not always need to comprise a roll, but may, of course, comprise a heated blade or other means for recovering ink, or means for distributing ink uniformly.

What is claimed is:

1. In a heat transfer type thermal recording apparatus of the type including a thermal heating element which is selectively heated in accordance with pictorial information, an ink donor sheet carrying ink on a surface thereof and travelling along a donor sheet path past said heating element, and a back roll adjacent said heating element for urging a recording sheet against said surface of said donor sheet in the vicinity of said heating element, whereby, upon selective heating of said heating element in accordance with image information, ink will be transferred to said recording sheet and a negative image will be left on said donor sheet, the improvement comprising:

heating means along said donor sheet path downstream of said heating element for erasing said negative image from said donor sheet by melting the remaining ink on said donor sheet and transferring melted ink to said heating means.

2. The improvement as claimed in claim 1, wherein said heating means comprises a rolling heating element.

3. The improvement as claimed in claim 2, wherein said rolling heating element contacts said ink donor sheet surface to spread the remaining ink thereon.

4. The improvement as claimed in claim 3, wherein said rolling heating element melts said remaining ink and collects melted ink between said rolling heating element and donor sheet upstream of a contact point between said rolling heating element and said donor sheet.

5. The improvement according to claim 2, further including means for removing the remaining ink from said rolling heating element.

6. The improvement as claimed in claim 5, wherein said means for removing comprises a scraper positioned to remove ink from said rolling heating element.

7. The improvement as claimed in claim 6, wherein said rolling heating element contacts said surface of said donor sheet from which ink was transferred to melt and pick up said ink, and said scraper removes ink accumulating on said rolling heating element.

* * * * *